United States Patent [19]

Sejbal et al.

[11] 3,967,655

[45] July 6, 1976

[54] APPARATUS FOR STABILIZING THE FABRIC WITHIN THE WEFT BEAT-UP AREA IN WAVE WEAVING LOOMS

[75] Inventors: Dalibor Sejbal; Josef Holub; Zbyněk Mikš; Vítězslav Vašek, all of Usti nad Orlici, Czechoslovakia

[73] Assignee: Vyzkumny Ustav Bavlnarsky, Usti nad Orlici, Czechoslovakia

[22] Filed: June 1, 1973

[21] Appl. No.: 366,127

[30] Foreign Application Priority Data

June 12, 1972 Czechoslovakia ..... 4051-72

[52] U.S. Cl. ..... 139/291 R; 139/436; 139/292

[51] Int. Cl.[2] ..... D03D 49/00; D03J 1/22; D03D 47/26

[58] Field of Search ..... 139/291 R, 292–298, 139/188 R, 12

[56] References Cited

UNITED STATES PATENTS

| | | | |
|---|---|---|---|
| 1,052,417 | 2/1913 | Jackson | 139/291 R |
| 1,520,434 | 12/1924 | Paschall | 139/291 R |
| 2,594,846 | 4/1952 | Bechter | 139/295 |
| 3,362,436 | 1/1968 | Fend | 139/291 R |
| 3,426,807 | 2/1969 | Pfarrwaller | 139/294 X |
| 3,621,886 | 11/1971 | Van Mullekom | 139/292 |
| 3,705,605 | 12/1972 | Titov | 139/188 R |
| 3,771,573 | 11/1973 | Horn et al. | 139/294 |

FOREIGN PATENTS OR APPLICATIONS

| | | | |
|---|---|---|---|
| 134,864 | 2/1880 | France | 139/291 R |
| 988,468 | 4/1965 | United Kingdom | 139/188 R |
| 7,550 | 1886 | United Kingdom | 139/291 R |
| 1,269 | 1866 | United Kingdom | 139/291 R |

*Primary Examiner*—James Kee Chi

[57] ABSTRACT

A method of and apparatus for stabilizing the fabric within the weft beat-up area in multiple-shed weaving machines or wave weaving loom wherein the beat-up is effected by means of a rotary reed. Immediately after the weft has been beaten-up, the fabric passes through a stabilization slot, and after having passed therethrough, it changes the direction of its movement beyond the level of the weaving plane.

3 Claims, 6 Drawing Figures

APPARATUS FOR STABILIZING THE FABRIC WITHIN THE WEFT BEAT-UP AREA IN WAVE WEAVING LOOMS

The invention relates to a method of and an apparatus for stabilizing the fabric within the weft beat-up area in multiple-shed or wave weaving looms wherein the beat-up is effected by means of a rotary reed.

The weaving conditions at the moment of beat-up a rotary reed in mulitple-shed or wave weaving machine are fundamentally different from those in a conventional weaving loom, wherein the beat-up is effected in a single phase simultaneously across the whole width of the warp drawn-in. At that moment, the whole "warp-fabric" system is also relieved and the fell of the fabric steadied.

When the beat-up is effected by means of a rotary reed as in the known mulitple-shed weaving machines, wherein the beat-up of the wefts being inserted takes place successively along the drawn-in width of the warp and under a continuous tension in the "warp-fabric" system, the fell of the fabric is in a constant motion and tends to lift itself onto the rotary reed. This phenomenon is the cause of disturbance situations which interfere with continuous weaving.

The pinned ring selvedge temples, which have either a constant inclination of the pinned rings or a differentiated inclination of the pinned rings, hold the fabric within the drawn-in width of the warp and also assist in the passage of the fabric: at the selvedges thereof, from the beat-up line to the said roller. The choice of an optimum number of the pinned rings in the selvedge temples, the overall angular range of the angle of inclination of the pinned rings, as well as the successive distribution of the latter with a possibility of adjusting the maximum tension, all assures the straightening of the fabric selvedges without the disturbing occurence of tracing.

However, in a multiple-shed weaving machine, the weft beat-up system utilizing a rotary reed requires that the conditions for a controllable and positionally established passage of the fell of the fabric, established by the selvedge temples, be similar along the whole width of the fabric. This requirement is fulfilled by the method and the device of the present invention which permits the achievement of a high stabilization of the fell of the fabric and also in the case of tighter warp sets as well.

In the method of the invention, the fabric passes immediately after the weft has been beaten-up through a stabilization slot and after having passed therethrough, it changes the direction of its movement beyond the level of the weaving plane.

In one of the embodiments of the apparatus of the invention, the stabilization slot is formed between a through bar interposed between the temples and a lower rail. Behind the stabilization slot there is provided a deflection rail, the top portion of which lies beyond the level of the weaving plane. In another embodiment of the apparatus of the invention, the stabilization slot is formed between an edge of a delimitation rail which is fixed on the through bar interposed between the temples and the lower rail, and behind the stabilization slot, a deflection rail is provided, the top portion of which lies beyond the level of the weaving plane.

Another feature resides in that the through bar lies in the space between the edge of the delimitation rail and the top portion of the deflection rail.

In a constructionally advantageous embodiment, there are holders provided on the through bar, such holders being adjustably fixed on the sleeves of a cross-beam.

Another advantageous feature in making of the delimitation rail, the lower rail and the deflection rail is adjustable in position.

Exemplary embodiments of the invention are diagrammatically shown in the accompanying drawings, in which.

Figure 1:
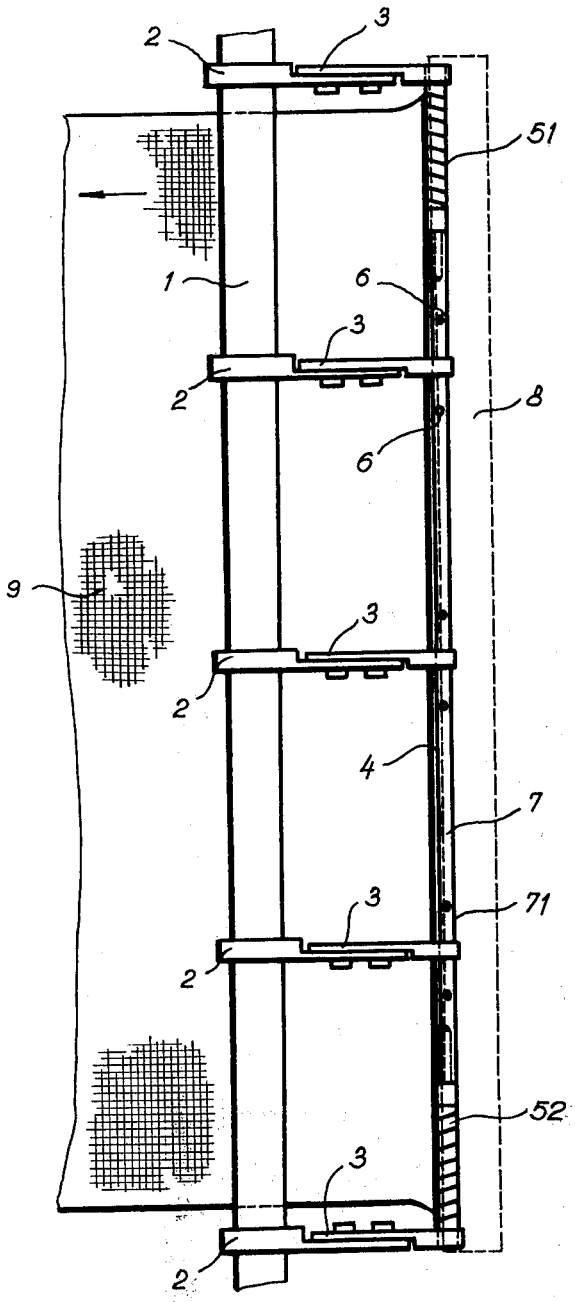
FIG. 1 is a plan view of a first embodiment of apparatus in accordance with the invention, such embodiment having a through cross-beam supporting a through bar with a delimitation rail.
Figure 2:
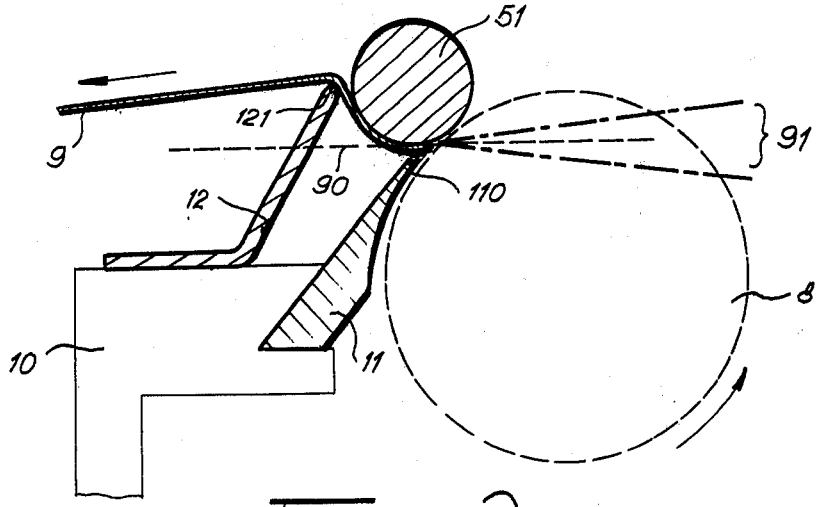
FIG. 2 is a section through a temple, a deflection rail and a lower rail, and indicating the path of the fabric.
Figure 3:
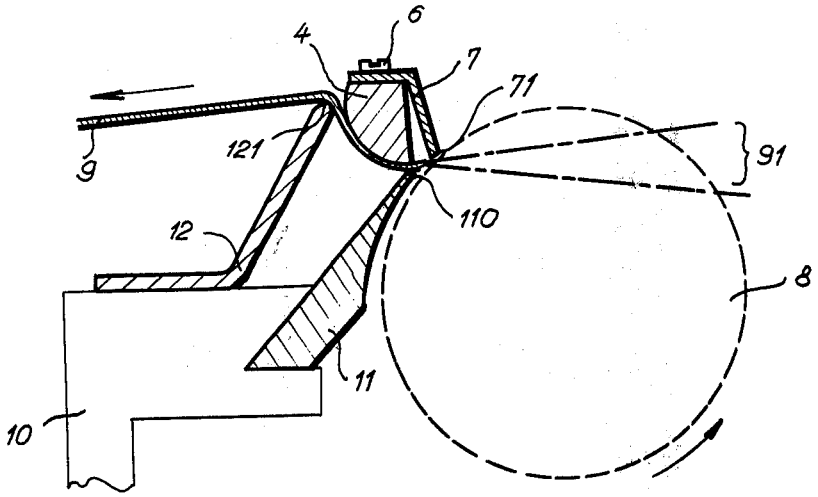
FIG. 3 is a section through a through bar, a delimitation rail, a deflection rail and a lower rail, and also indicating the path of the fabric.
Figure 4:
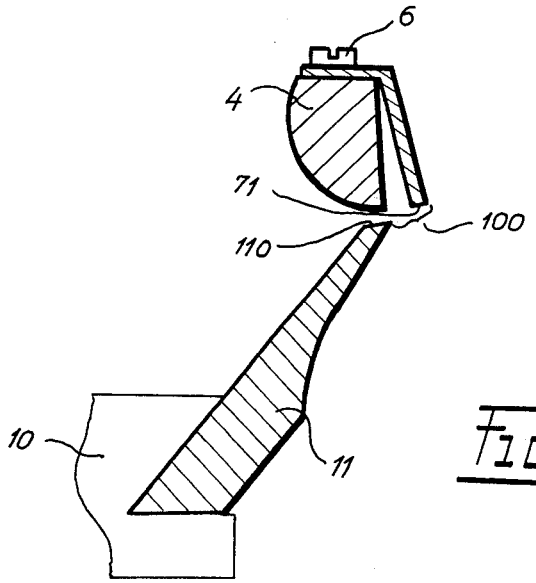
FIG. 4 is an enlarged view of a stabilization slot, without the fabric.

Turning now to FIGS. 1–4, and, showing a first illustrative embodiment of apparatus, in accordance with the invention; fast on the machine frame (not shown) there is a fixed cross-beam 1 supporting sleeves 2 on which are adjustably fixed holders 3 which carry a through bar 4. At the two ends of the through bar 4 temples 51, 52 are rotatably mounted with their ends facing each other; their outer ends are fastened similarly to the through bar 4, on the cross-beam 1.

On the through bar 4, fixedly mounted by means of screws 6, is a delimitation rail 7, the edge 71 of which lies in close proximity of a known rotary reed 8, at the beat-up point of the weft inserted into the shed 91.

Attached to a beam 10 of the machine frame (not shown) and across the width of a fabric 9 are a lower rail 11 and behind the latter, a deflection rail 12.

The edge 71 of the delimitation rail 7 forms, together with the lower rail 11, a stabilization slot 100; behind the latter, the deflection rail 12 is disposed in such a way that its top portion 121 lies above, i.e. beyond the level of the weaving plane 90. The through bar 4 is advantageously located in the space between the edge 71 of the delimitation rail 7 and the top portion 121 of the deflection rail 12.

Advantageously, the delimitation rail 7, the lower rail 11 and the deflection rail 12 may be positionally adjustable which may be achieved by very simple and, therefore, non-illustrated means.

Figure 6:
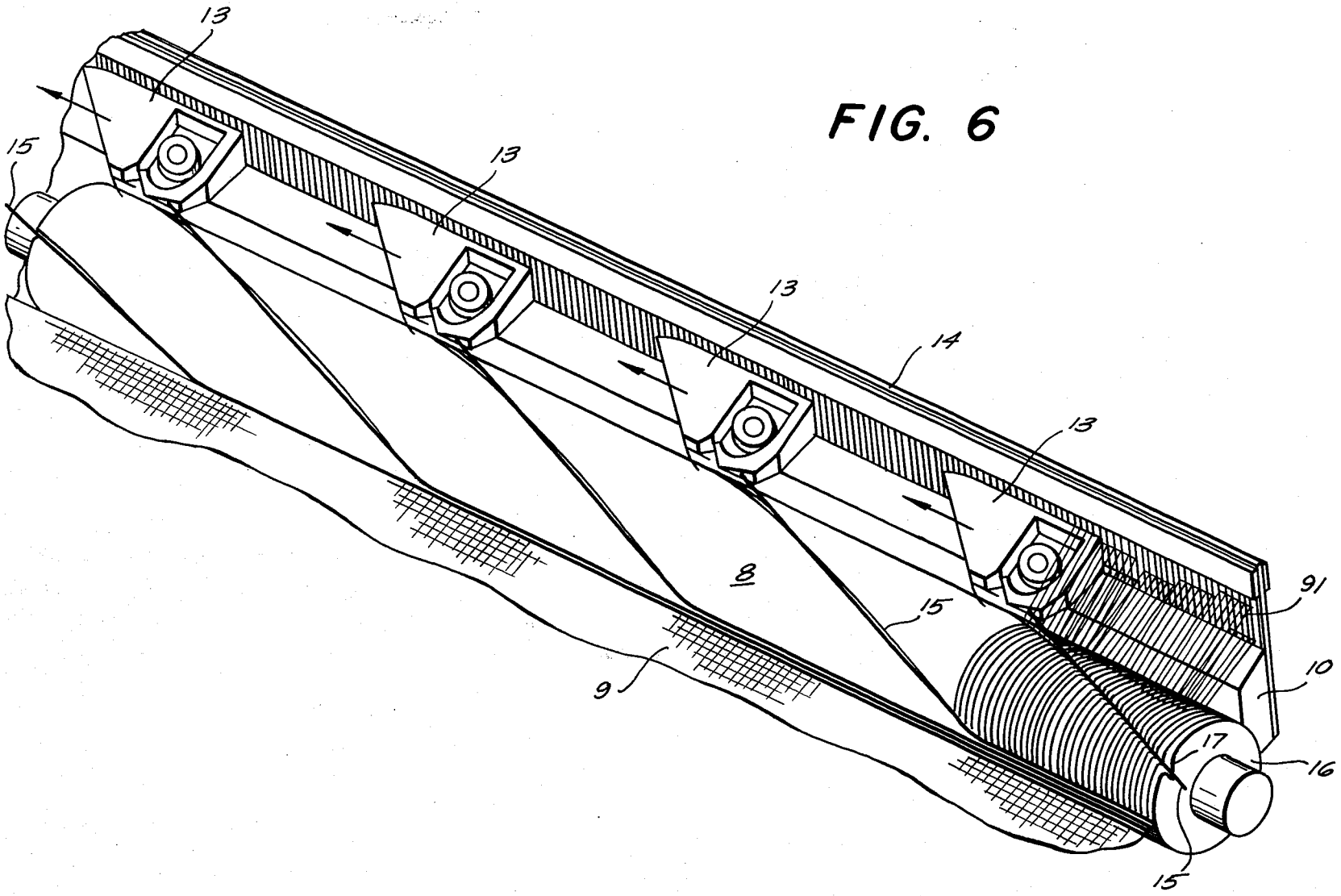
FIG. 6 is a fragmentary view in perspective showing the rotary reed with weft inserters.

In FIG. 6 there is shown the beam 10 of the machine frame on which the rotary reed 8 is supported by bearing means, not shown. The woven fabric is shown at 9. The reference character 14 designates an immovable beam feeding warp threads, a plurality of weft inserters 13 being shown moving to the left, that is, in the direction of the arrows. The weft is designated 15, and the segments of the rotary reed 8 are designated 16. The segments 16 have cut-outs 17 for the reception of the weft. The right hand weft inserters 13 are shown passing through a shed 91 of the warp threads.

Figure 5:
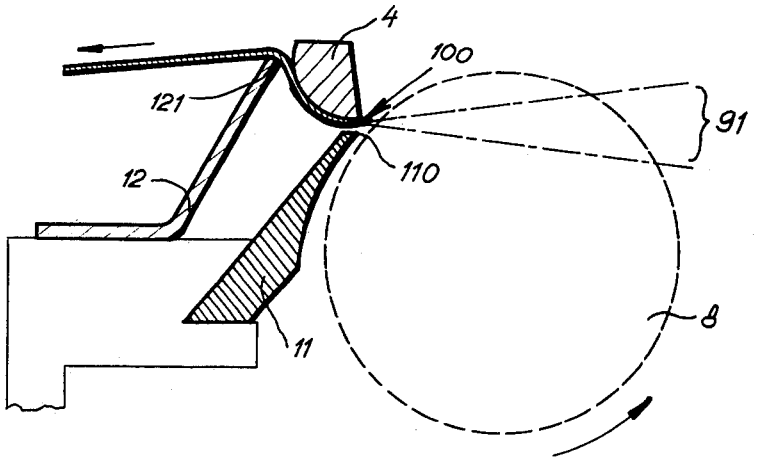
FIG. 5 is a sectional view of a second embodiment of apparatus in accordance with the invention having a stabilization slot formed directly by a through bar and a lower rail.

In the embodiment according to FIG. 5, the stabilization slot 100 is formed, on the one hand, directly by the through bar 4 and, on the other hand, by the lower rail 11; thus the delimitation rail is omitted in this embodiment.

The arrangement described with reference to FIG. 1 to 4 permits the through bar 4 with the selvedge temples 51, 52 to be adjusted to and locked in a vertical position in such a way as to determine the weaving plane 90 of the machine. The forces which are produced by the tension in the "warp-fabric 9" system and acting against the delimitation rail 7 and the through bar 4 with the selvedge temples 51, 52, are intercepted by the fixed rigid cross-beam 1 which is anchored in the machine frame. The adjusting and securing of the optimum value of tension to keep the fabric 9 at the drawn in thread width of the warp is effected by means of the selvedge temples 51, 52.

The described construction permits the through bar 4 to be located with the selvedge temples 51, 52 and with the delimitation rail 7 in the immediate proximity of the beat-up edge of the rotary reed 8 within the weaving plane 90; this is necessary to ensure the stabilization of the fell of the fabric 9, and is essential for securing continuous weaving. Stabilization of the fell of the fabric 9 is also assisted by the edge 71 of the delimitation rail 7 disposed on the through bar 4 and extending along the whole width as far as the pinned rings of the selvedge temples 51, 52. The delimitation rail 7 on the through bar 4 is adjusted with respect to its edge 71 relative to the point of the beat-up edge of the rotary reed 8 within the weaving plane 90 in such a way that it prevents the fell of the fabric 9 from lifting onto the rotary reed 8 and thus delimitates in height the area of formation of the fabric 9. The edge 71 is usually positioned directly at the point of the beat-up edge of reed 8.

The upper edge 110 of the lower rail 11 is positioned, across the whole width of the rotary reed 8, approximately 1-1.5 mm beneath the weaving plane 90 defined by the through bar 4 and, at the same time, the upper edge 110 prevents, within the minimum possible distance from the rotary reed, the fell of the fabric 9 from being carried away by the beat-up edge of the rotary reed 8. The passage of the fabric 9 from the beat-up edge of the rotary reed 8 onto the said roller (not shown) is given by the position of the weaving plane 90, the latter being determined by the stabilization slot 100 and the top portion 121 of the deflection rail 12. Due to this, it is possible to cause the fabric 9, immediately after the weft has been beaten-up, to pass through the stabilization slot 100 and, after having passed therethrough, immediately to change its direction of movement beyond the weaving plane 90, thereby, there can be secured an optimum angle of the fabric 9 over the through bar 4 and the selvedge temples 51, 52; this is necessary for a reliable operation of the pinned rings of the selvedge temples 51, 52.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An apparatus for stabilizing the fabric within the weft beat-up area in a travelling-wave shedding loom, wherein the beat-up is effected by means of a rotary reed, the improvement which comprises means forming a stabilization slot, and a deflection rail downstream of said means, the top portion of said deflection rail lying above the level of the weaving plane, the means for forming the stabilization slot comprising delimitation rail having a top edge and fixed on a through bar along the weaving plane, and a lower rail.

2. Apparatus as claimed in claim 1, wherein the through bar lies in the space between the edge of the delimitation rail and the bottom part of the deflection rail.

3. Apparatus as claimed in claim 2, comprising means for relatively adjusting the delimitation rail, the lower rail, and the deflection rail.

* * * * *